US007551144B2

(12) United States Patent
Manholm et al.

(10) Patent No.: US 7,551,144 B2
(45) Date of Patent: Jun. 23, 2009

(54) TRIPLE POLARIZED CLOVER ANTENNA WITH DIPOLES

(75) Inventors: Lars Manholm, Gothenburg (SE); Fredrik Harrysson, Gothenburg (SE); Jonas Medbo, Uppsala (SE)

(73) Assignee: Telefonaktiebolaget L M Ericsson (Publ), Stockholm (SE)

( * ) Notice: Subject to any disclaimer, the term of this patent is extended or adjusted under 35 U.S.C. 154(b) by 46 days.

(21) Appl. No.: 11/913,014

(22) PCT Filed: Apr. 29, 2005

(86) PCT No.: PCT/SE2005/000642

§ 371 (c)(1),
(2), (4) Date: Oct. 29, 2007

(87) PCT Pub. No.: WO2006/118496

PCT Pub. Date: Nov. 9, 2006

(65) Prior Publication Data

US 2008/0191955 A1 Aug. 14, 2008

(51) Int. Cl.
*H01Q 21/00* (2006.01)
*H01Q 21/26* (2006.01)

(52) U.S. Cl. ..... 343/726; 343/797

(58) Field of Classification Search ..... 343/726, 343/797, 795, 855, 893
See application file for complete search history.

(56) References Cited

U.S. PATENT DOCUMENTS

| | | | | |
|---|---|---|---|---|
| 2,871,477 | A * | 1/1959 | Hatkin | 343/728 |
| 4,588,993 | A * | 5/1986 | Babij et al. | 342/351 |
| 6,646,615 | B2 * | 11/2003 | Andrews et al. | 343/726 |
| 2002/0113748 | A1 | 8/2002 | Andrews | |

* cited by examiner

*Primary Examiner*—Shih-Chao Chen
(74) *Attorney, Agent, or Firm*—Roger S. Burleigh

(57) ABSTRACT

The present invention relates to an antenna arrangement comprising a constant current electrical loop, which is arranged to provide a first essentially toroid-shaped radiation pattern, where the antenna arrangement further comprises a first and a second electrical dipole. The electrical dipoles are arranged essentially orthogonal to each other, and are arranged to provide a second and third essentially toroid-shaped radiation pattern which each is essentially orthogonal to the other and to the first essentially toroid-shaped radiation pattern. The constant current electrical loop comprises at least two current path parts, where a current can be applied to each one of the parts, so that the current in each one of the parts essentially will be in phase with each other.

7 Claims, 8 Drawing Sheets

TRIPLE POLARIZED CLOVER ANTENNA WITH DIPOLES

TECHNICAL FIELD

The present invention relates to an antenna arrangement comprising means for providing an approximation of a constant current electrical loop, which approximation of a constant current electrical loop is arranged to provide a first essentially toroid-shaped radiation pattern, where the antenna arrangement further comprises a first and a second electrical dipole, which electrical dipoles are arranged essentially orthogonal to each other, and are arranged to provide a second and third essentially toroid-shaped radiation pattern which each is essentially orthogonal to the other and to the first essentially toroid-shaped radiation pattern.

BACKGROUND ART

The demand for wireless communication systems has grown steadily, and is still growing, and a number of technological advancement steps have been taken during this growth. In order to acquire increased system capacity for wireless systems by employing uncorrelated propagation paths, MIMO (Multiple Input Multiple Output) systems have been considered to constitute a preferred technology for improving the capacity. MIMO employs a number of separate independent signal paths, for example by means of several transmitting and receiving antennas. The desired result is to have a number of uncorrelated antenna ports for receiving as well as transmitting.

For MIMO it is desired to estimate the channel and continuously update this estimation. This updating may be performed by means of continuously transmitting so-called pilot signals in a previously known manner. The estimation of the channel results in a channel matrix. If a number of transmitting antennas Tx transmit signals, constituting a transmitted signal vector, towards a number of receiving antennas Rx, all Tx signals are summated in each one of the Rx antennas, and by means of linear combination, a received signal vector is formed. By multiplying the received signal vector with the inverted channel matrix, the channel is compensated for and the original information is acquired, i.e. if the exact channel matrix is known, it is possible to acquire the exact transmitted signal vector. The channel matrix thus acts as a coupling between the antenna ports of the Tx and Rx antennas, respectively. These matrixes are of the size M×N, where M is the number of inputs (antenna ports) of the Tx antenna and N is the number of outputs (antenna ports) of the Rx antenna. This is previously known for the skilled person in the MIMO system field.

In order for a MIMO system to function efficiently, uncorrelated, or at least essentially uncorrelated, transmitted signals are required. The meaning of the term "uncorrelated signals" in this context is that the radiation patterns are essentially orthogonal. This is made possible for one antenna if that antenna is made for receiving and transmitting in at least two orthogonal polarizations. If more than two orthogonal polarizations are to be utilized for one antenna, it is necessary that it is used in a so-called rich scattering environment having a plurality of independent propagation paths, since it otherwise is not possible to have benefit from more than two orthogonal polarizations. A rich scattering environment is considered to occur when many electromagnetic waves coincide at a single point in space. Therefore, in a rich scattering environment, more than two orthogonal polarizations can be utilized since the plurality of independent propagation paths enables all the degrees of freedom of the antenna to be utilized.

Antennas for MIMO systems may utilize spatial separation, i.e. physical separation, in order to achieve low correlation between the received signals at the antenna ports. This, however, results in big arrays that are unsuitable for e.g. hand-held terminals. One other way to achieve uncorrelated signals is by means of polarization separation, i.e. generally sending and receiving signals with orthogonal polarizations.

It has then been suggested to use three orthogonal dipoles for a MIMO antenna with three ports, but such an antenna is complicated to manufacture and requires a lot of space when used at higher frequencies, such as those used for the MIMO system (about 2 GHz).

In US 2002/0113748, two preferably orthogonally arranged dipoles and a loop element is disclosed. As shown in FIG. 5 of said application, the loop element is in the form of a ring, fed at a certain point in the ring.

As the diameter of the loop element is suggested to be up to one wavelength at the working frequency, it is thus indicated that the loop may be several wavelengths long.

However, in order to acquire a radiation pattern that is essentially orthogonal to the dipole patterns using the antenna arrangement according to US 2002/0113748, one method is to use a small loop. Such a small loop should have a diameter of about a tenth wavelength at the working frequency, resulting in an approximation of a constant current electrical loop element. Using a constant current electrical loop, or at least a sufficient approximation thereof, is an advantageous method to acquire a radiation pattern that is essentially orthogonal to the dipole patterns.

Although not proposed explicitly in US 2002/0113748, such a small loop antenna could be deduced from said document. Said small loop antenna is, however, quite narrow-banded and hence difficult to match properly since it has a high reactive resistance and a low resistive resistance. Further, such a small loop antenna is considerably smaller than the adjacent dipole antennas, resulting in an awkward construction.

There is thus a problem with the antenna arrangement according to US 2002/0113748, since the loop element has to be very small in order to function as a sufficient approximation of a constant current loop element.

The objective problem that is solved by the present invention is to provide an antenna arrangement suitable for a MIMO system, which antenna arrangement is capable of sending and receiving in three essentially uncorrelated polarizations, and should comprise two essentially orthogonal dipoles and an approximation of constant current electrical loop element. The approximation of the constant current electrical loop element should further be easily matched and have a large bandwidth compared to what may be concluded from prior art solutions.

DISCLOSURE OF THE INVENTION

This objective problem is solved by means of an antenna arrangement according to the introduction, which antenna arrangement further is characterized in that the means for approximation of the constant current electrical loop comprises at least two current path parts, where a current can be applied to each one of said parts, so that the current in each one of said parts essentially will be in phase with each other.

Preferred embodiments are disclosed in the dependent claims.

Several advantages are achieved by means of the present invention, for example:

A low-cost triple polarized antenna arrangement is obtained.

A triple polarized antenna made in planar technique is made possible, avoiding space consuming antenna arrangements.

A triple polarized antenna which is easy to manufacture is obtained.

BRIEF DESCRIPTION OF THE DRAWINGS

The present invention will now be described more in detail with reference to the appended drawings, where.

PREFERRED EMBODIMENTS

According to the present invention, a so-called triple-mode antenna arrangement is provided. The triple-mode antenna arrangement is designed for transmitting three essentially orthogonal radiation patterns.

Figure 1:
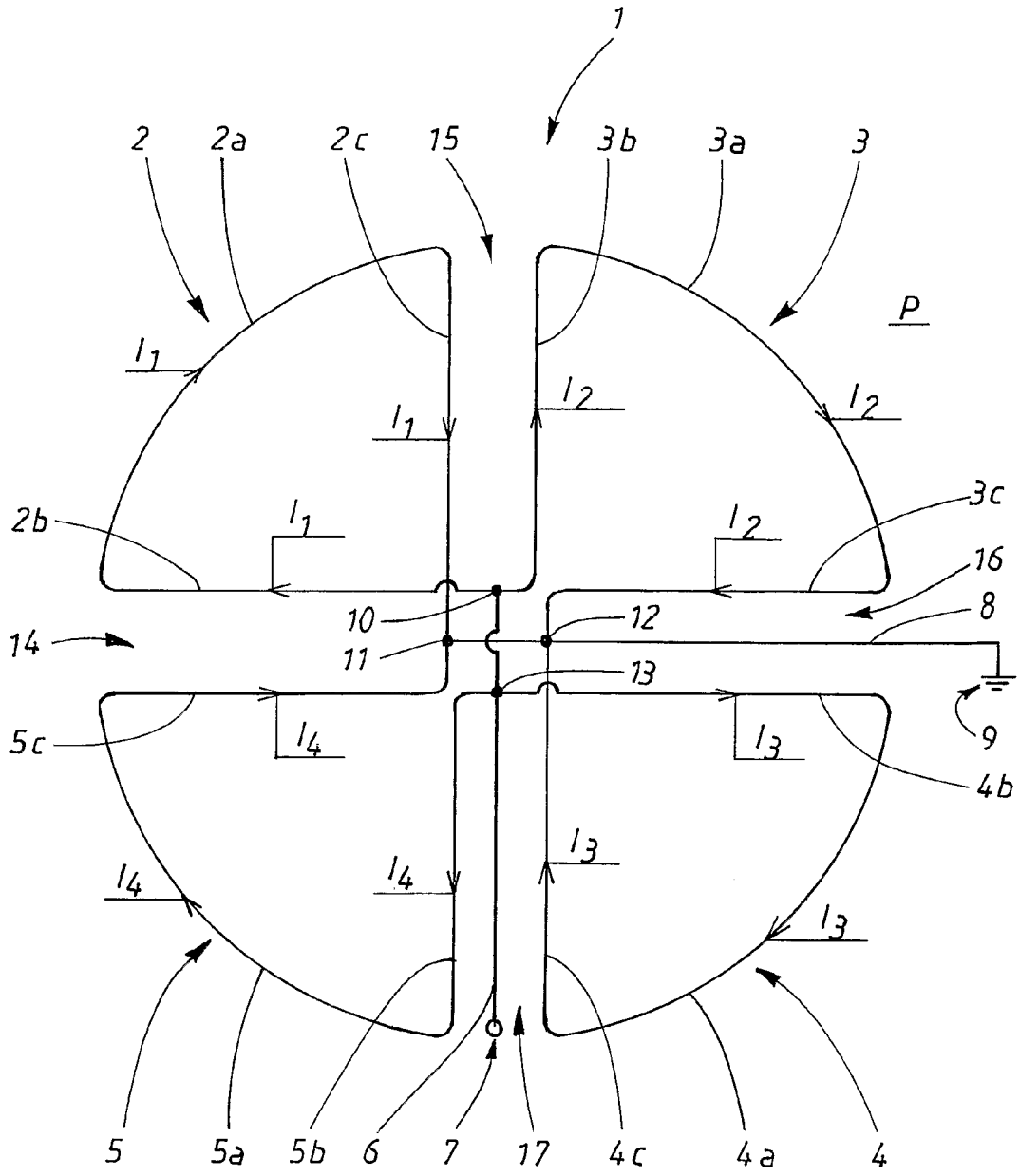
FIG. 1 shows a four-leaf clover antenna.

A so-called four-leaf clover antenna 1, which is previously known, is used in the present invention, and is shown in FIG. 1. The four-leaf clover antenna 1 comprises a first 2, second 3, third 4 and fourth 5 loop of a conductive material, for example a bent copper wire, where the loops 2, 3, 4, 5 all mainly lie in the same plane, an antenna plane P in the plane of the paper in FIG. 1. Each loop 2, 3, 4, 5 runs from a feeding conductor 6, having a feeding port 7, to a ground conductor 8, leading to ground 9, preferably they are all connected to the same feeding conductor 6. The loops 2, 3, 4, 5 are preferably essentially of the same length and positioned beside each other in a symmetrical circular clover pattern, as shown in FIG. 1.

When following the first loop 2, it starts at a first feeding connection point 10 where it contacts the feeding conductor 6, runs clockwise and terminates in a first ground connection point 11 where it contacts the ground conductor 8. The second loop 3, positioned clockwise relative to the first loop 2, also starts at the first feeding connection point 10, where it contacts the feeding conductor 6, runs clockwise and terminates in a second ground connection point 12 where it contacts the ground conductor 8.

The third loop 4, positioned clockwise relative to the second loop 3, starts at the a second feeding connection point 13, where it contacts the feeding conductor 6, runs clockwise and terminates in the second ground connection point 12 where it contacts the ground conductor 8. The fourth loop 5, positioned clockwise relative to the third loop 4, starts at the second feeding connection point 13, where it contacts the feeding conductor 6, runs clockwise and terminates in the first ground connection point 11, where it contacts the ground conductor 8.

Each loop 2, 3, 4, 5 comprises an arcuate conductor part 2*a*, 3*a*, 4*a*, 5*a* and a first 2*b*, 3*b*, 4*b*, 5*b* and second 2*c*, 3*c*, 4*c*, 5*c* straight conductor part. The straight conductor parts 2*b*, 2*c* of the first loop 2 will form a first 14 and second 15 parallel pair conductor part together with the adjacent straight conductor parts 5*c*, 3*b* of the adjacent fourth 5 and second 3 loops. In the same way, third 16 and fourth 17 parallel pair conductor parts are formed. The arcuate conductor parts 2*a*, 3*a*, 4*a*, 5*a* extend in such a way that they together form an incomplete essentially circular conducting part. The term incomplete refers to that the essentially circular conducting part is broken between each arcuate conductor part 2*a*, 3*a*, 4*a*, 5*a*.

As all the loops 2, 3, 4, 5 are fed from the same feeding conductor 6, current $I_1$, $I_2$, $I_3$, $I_4$ in each loop will all be essentially in phase with each other. In particular, in each arcuate conductor part 2*a*, 3*a*, 4*a*, 5*a*, the current $I_1$, $I_2$, $I_3$, $I_4$ will be in phase with the current $I_1$, $I_2$, $I_3$, $I_4$ in all the other arcuate conductor parts 2*a*, 3*a*, 4*a*, 5*a*. Further, when regarding the first parallel pair conductor part 14, the currents $I_1$, $I_4$ in the included straight conductor parts 2*b*, 5*c* run in opposite directions, cancelling each other. The corresponding condition applies for the second 15, third 16 and fourth 17 parallel pair conductor parts.

This means that a the four-leaf clover antenna 1, by means of superposition of the loops 2, 3, 4, 5, in effect is an approximation of a conducting ring where the current has the same phase all over the ring. This means that an approximation of an ideal so-called constant current electrical loop is obtained. The discrepancies of the approximation mainly arise from the fact the arcuate conductor parts 2*a*, 3*a*, 4*a*, 5*a* do not form a complete and accurate circle, and that the current $I_1$, $I_2$, $I_3$, $I_4$ in each arcuate conductor part 2*a*, 3*a*, 4*a*, 5*a* does not have the same phase along the arcuate conductor part 2*a*, 3*a*, 4*a*, 5*a* in question.

It is possible to use more or fewer clover loops, the more clover loops that are used, the more accurate the approximation of the ideal conducting ring becomes. On the other hand, the more clover loops that are used, the more complicated the antenna structure becomes. In the embodiment examples shown, a four leaf clover antenna 1 is used. Further, the smaller the clover antenna that is used, measured in wavelengths, the better the approximation becomes, since the current then varies to a smaller extent along the arcuate conductor part 2*a*, 3*a*, 4*a*, 5*a* in question. A wavelength here preferably refers to the center wavelength of the operational bandwidth of the antenna arrangement according to the invention.

Figure 2:
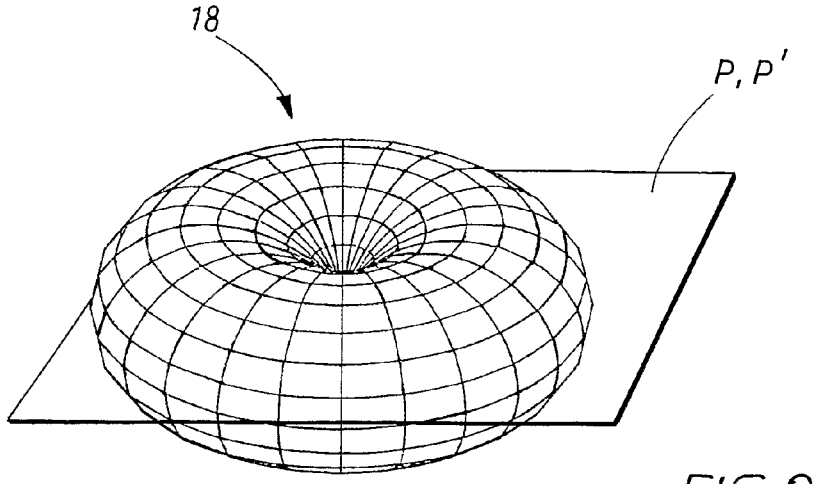
FIG. 2 shows an ideal radiation pattern for a constant current electrical loop.

The ideal radiation pattern 18 of a constant current electrical loop, which is approximated by a four-leaf clover antenna, is shown in FIG. 2, and is shaped as a toroid ring, where the arc of the toroid ring essentially follows the arcuate conductor parts 2*a*, 3*a*, 4*a*, 5*a* of the four-leaf clover antenna 1. The constant current electrical loop ideal radiation pattern 18 has a longitudinal symmetry plane P' that divides the toroid ring in two equal circular halves, which longitudinal toroid ring symmetry plane P' thus coincide with the four-leaf clover antenna plane P.

Figure 3:
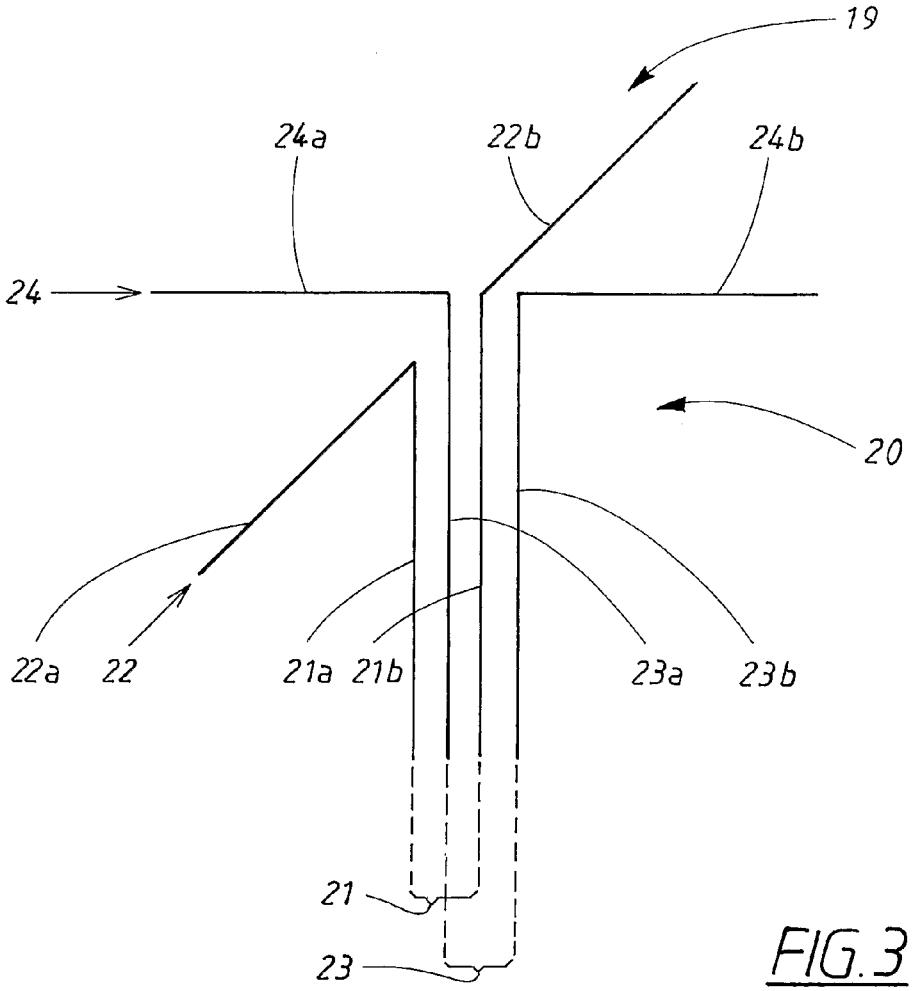
FIG. 3 shows two orthogonal dipole antennas.

According to the present invention, the four-leaf clover antenna is combined with a first 19 and a second 20 dipole, orthogonally arranged, as shown in FIG. 3, which first 19 and second 20 dipoles are made in a conductive material, for example a bent copper wire. The first dipole 19 comprises a first feeding part 21 with two parallel conductors 21*a*, 21*b* and a first arm part 22, comprising two dipole arms 22*a*, 22*b*, where the two feeding conductors 21*a*, 21*b* are bent 90° in such a way that the conductors, or dipole arms 22*a*, 22*b*, now extend in opposite directions until they reach their ends. The second dipole 20 comprises a corresponding second feeding part 23 and second arm part 24 with corresponding feeding conductors 23*a*, 23*b* and dipole arms 24*a*, 24*b*. The conducting parts 21, 22, 23, 24 are preferably of essentially the same length.

Figure 4:
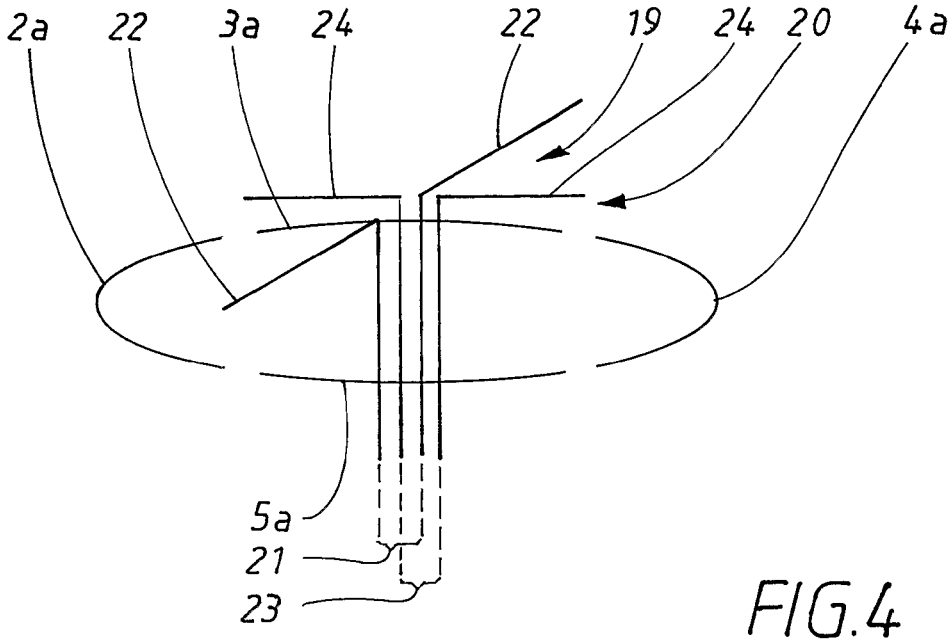
FIG. 4 shows a four-leaf clover antenna with two orthogonal dipole antennas.

With reference to FIG. 4, the dipoles 19, 20 are arranged in the center of the four-leaf clover antenna, shown schematically with the arcuate conductor parts 2*a*, 3*a*, 4*a*, 5*a* only. The dipoles 19, 20 have their respective feeding parts 21, 23 rising perpendicularly to the four-leaf clover antenna plane P (not shown in FIG. 4) and the respective arm part 22, 24 extend essentially parallel to the four-leaf clover antenna plane. The extension of the first arm part 22 is essentially orthogonal to the extension of the second arm part 24.

Figure 5:
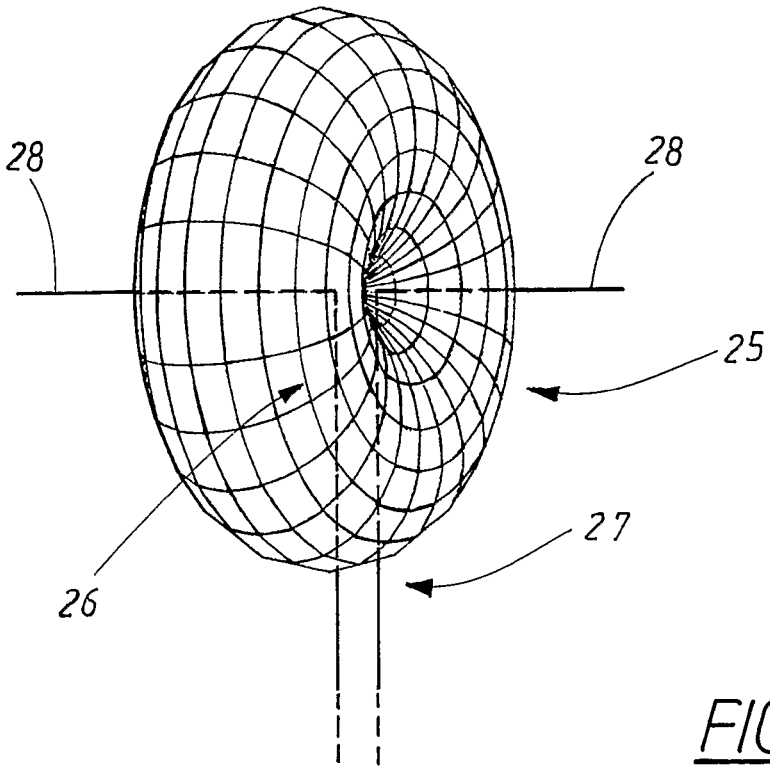
FIG. 5 shows an ideal radiation pattern for a dipole antenna.

The ideal radiation pattern 25 of a dipole antenna 26, having a feeding part 27 and a arm part 28, is shown in FIG. 5, and is shaped as a toroid ring. The arm part 28 of the dipole antenna 26 constitutes a center axis around which the radiation pattern's 25 toroid ring is formed. In other words, the arcuate shape of the radiation pattern 25 runs around the arm part 28 in such a way that the extension of the arm 28 part forms a central symmetry line for the toroid ring.

Figure 6:
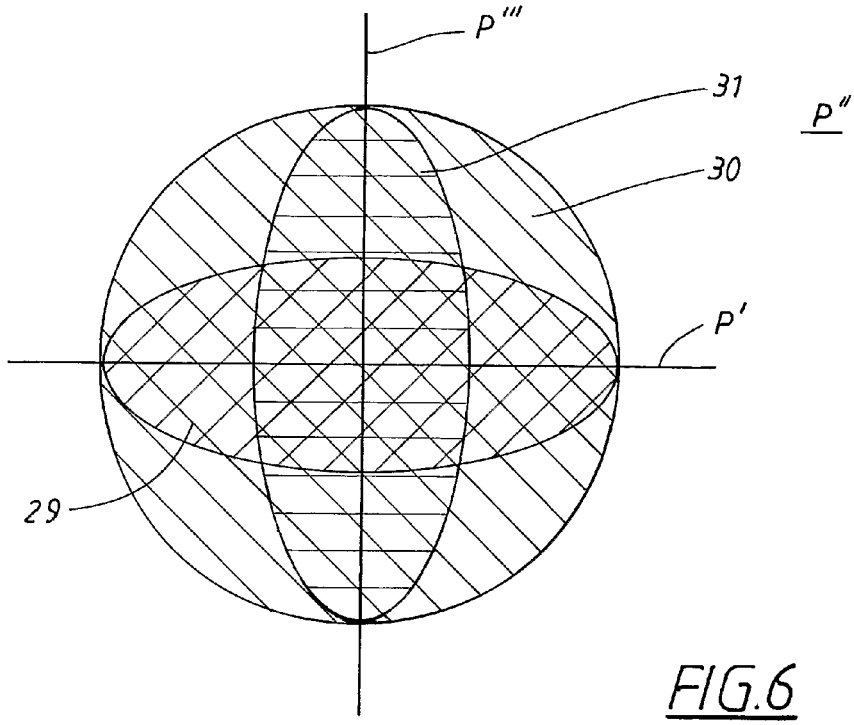
FIG. 6 shows three orthogonal radiation patterns.

Regarding the antenna according to the present invention, with reference to FIG. 6, the antenna diagrams produced are shown in a side view, where the four-leaf clover antenna plane P runs perpendicular to the plane of the paper.

The four leaf clover antenna 1 produces a first toroid-shaped radiation pattern 29, having the first longitudinal toroid ring symmetry plane P'. The first radiation pattern 29 is marked with tilted lines which increase from left to right.

The first dipole antenna 19 produces a second toroid-shaped radiation pattern 30, having a second longitudinal toroid ring symmetry plane P" which coincide with, or is parallel with, the plane of the paper and is orthogonal to the first longitudinal toroid ring symmetry plane P'. The second radiation pattern 30 is marked with tilted lines which decrease from left to right.

The second dipole antenna 20 produces a third toroid-shaped radiation pattern 31, having a third longitudinal toroid ring symmetry plane P"' which is orthogonal to both the first longitudinal toroid ring symmetry plane P' and the second longitudinal toroid ring symmetry plane P". We thus have a first P', a second P" and a third P"' plane. The third radiation pattern 31 is marked with horizontal lines.

Ideally, as shown in FIG. 6, these radiation patterns 29, 30, 31 have the same phase center, but practically the second 30 and third 31 radiation patterns may be elevated or lowered relative to the first radiation pattern 29. Such a deviation should preferably be small measured in wavelengths, for example about $\lambda/10$, where $\lambda$ is the center wavelength of the operational bandwidth of the antenna arrangement.

As the longitudinal toroid ring symmetry planes P', P", P"' are orthogonal to each other, the radiation patterns are orthogonal to each other, according to the definition below.

As a conclusion, by means of the present invention, three different toroid-shaped radiation patterns 29, 30, 31 are acquired, where each radiation pattern is orthogonal to the other.

As the radiation patterns are orthogonal, the correlation equals zero, where the correlation ρ may be written as $$\rho = \frac{\oint_{\Omega} \vec{E}_1(\Omega) \cdot \vec{E}_2^*(\Omega) d\Omega}{\sqrt{\oint_{\Omega} |\vec{E}_1(\Omega)|^2 d\Omega \cdot \oint_{\Omega} |\vec{E}_2(\Omega)|^2 d\Omega}}$$

In the equation above, Ω represents a surface and the symbol * denotes a complex conjugate. For the integration of the radiation pattern, Ω represents a closed surface comprising all space angels, and when this integration equals zero, there is no correlation between the radiation patterns, i.e. the radiation patterns are orthogonal to each other. The denominator is an effect normalization term.

Having three, at least essentially, orthogonal radiation patterns is very desirable, since this enables uncorrelated parallel channels in a rich scattering environment, i.e. the rows in the channel matrix may be independent. This in turn means that the present invention is applicable for a MIMO system.

In the previously described first embodiment, the four-leaf clover antenna and the first and second dipoles are made by a bent wire, for example a copper wire. Any other conducting material will perform the function of the present invention.

In a second embodiment, the four-leaf clover antenna and the first and second dipoles are made in planar techniques, constituting a microstrip antenna. As shown schematically in FIG. 7, the triple-mode antenna according to the present invention then comprises a first 32, second 33, third 34 and fourth 35 copper-clad dielectric laminate, for example a Teflon-based laminate, placed on top of each other. Be removing the copper, different conducting structures may be formed on the laminates 32, 33, 34, 35. Removal of copper may be made by means etching, or, alternatively, milling.

Figure 7:
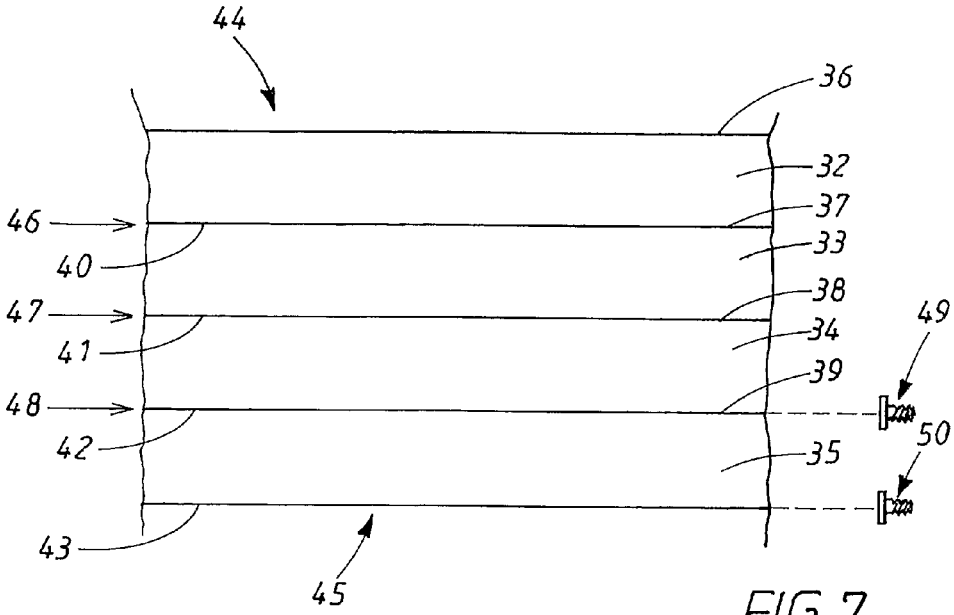
FIG. 7 shows a side view of the antenna arrangement according to the invention realized in planar techniques.

In FIG. 7, the first 32, second 33, third 34 and fourth 35 laminates, each one having a first 36, 37, 38, 39 and second 40, 41, 42, 43 side, are shown from the side, forming a sandwich structure. The sandwich structure has a top 44, a bottom 45 and a first 46, second 47 and third 48 intermediate section, where each intermediate section 46, 47, 48 is formed between two adjacent laminates.

On the top 44, on the first side 36 of the first laminate 32, the dipole arm parts are formed. Below, at the first intermediate section 46 between the first 32 and second 33 laminate, the four-leaf clover loops are formed, either on the second side 40 of the first laminate 32 or on the first side 37 of the second laminate 33. On the side not used, all copper is removed.

Further below, at the second intermediate section 47 between the second 33 and third 34 laminate, the four-leaf clover loops are combined in such way that every loop is connected to a common feed line and a common ground by means of vias (not shown) connecting the first 46 and second 47 intermediate sections. A combining network is then formed, either on the second side 41 of the second laminate 33 or on the first side 38 of the third laminate 34. On the side not used, all copper is removed.

Further below, at the third intermediate 48 section, between the third 34 and fourth 35 laminate, the dipole arm parts are combined in such way that they are connected to respective feed lines and a common ground by means of vias (not shown) connecting the top 44 and the third 48 intermediate section 42. Further, a four-leaf clover feeding line is formed at the third intermediate section 48, by means of vias (not shown) connecting the second 47 and third 48 intermediate sections. The four-leaf clover feeding line is connected to a clover antenna connector 49 at the edge of the sandwich. Thus a combining network is formed, either on the second side 42 of the third laminate 34 or on the first 39 side of the fourth laminate 35. On the side not used, all copper is removed.

At the bottom 45, on the second side 43 of the fourth laminate 35, a dipole feeding line is formed for each dipole by means of vias (not shown), connecting the second intermediate section 47 and the bottom 45. Each dipole feeding line is connected to a dipole antenna connector 50 (only one shown) at the edge of the sandwich.

Figure 8A:
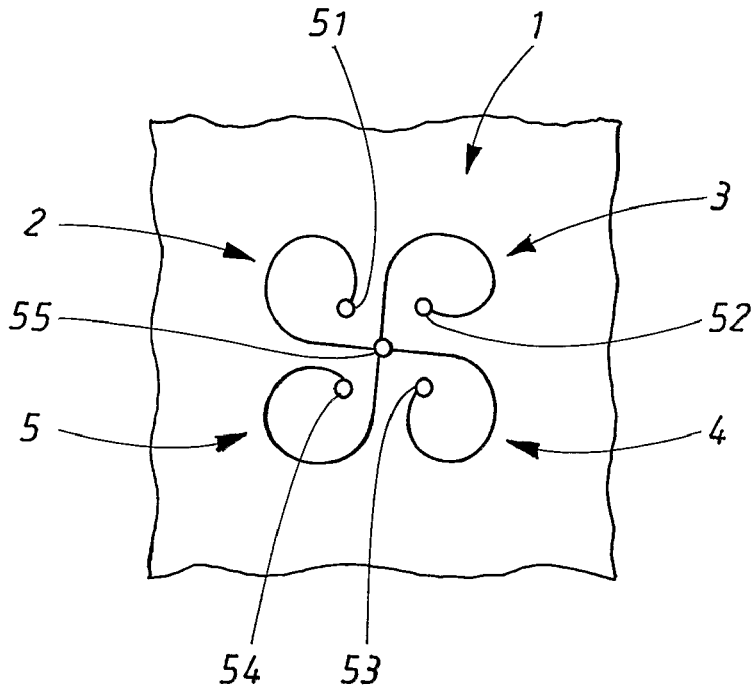
FIG. 8*a* shows a four-leaf clover antenna realized in planar techniques.

An example of how the etched clover arms and their feeding vias may look like is shown in FIG. 8*a*. There, an etched four-leaf clover antenna 1 comprising the first 2, second 3, third 4 and fourth 5 loop is shown. Each loop is connected to a corresponding first 51, second 52, third 53 and fourth 54 via. These vias 51, 52, 53, 54 are joined to one point at another point, in the example with reference to FIG. 7 in another layer. A fifth common central via 55 is also provided, thus totally resulting in two terminals for feeding the four-leaf clover antenna 1, in the example with reference to FIG. 7 these terminals are available via the clover antenna connector 49.

Figure 8B:
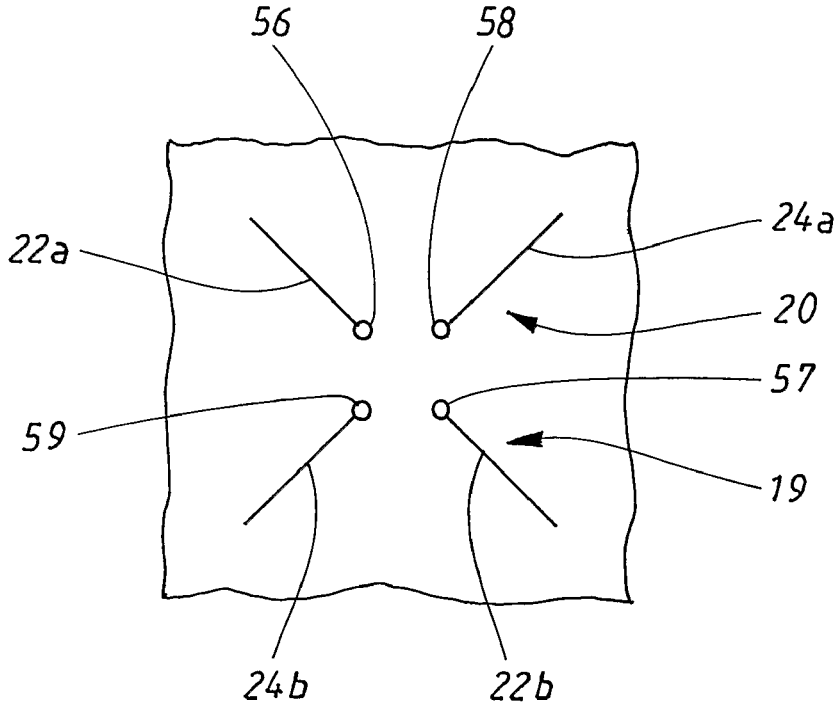
FIG. 8*b* shows two orthogonal dipole antennas realized in planar techniques.

Further, in FIG. 8*b*, an example of how the etched dipole arms and their feeding vias may look like is shown. The first dipole 19 has its dipole arms 22*a*, 22*b* connected to a respective first 56 and second 57 dipole via. The second dipole 20 has its dipole arms 24*a*, 24*b* connected to a respective first 58 and second 59 dipole via. These vias 51, 52, 53, 54 are preferably brought to another layer, as described in the example with reference to FIG. 7, where each dipole is available via a connector 50 corresponding to the vias 56, 57; 58, 59 of each dipole.

Due to reciprocity, for the transmitting properties of all the triple-mode antenna arrangements described, there are corresponding equal receiving properties, as known to those skilled in the art, allowing the triple-mode antenna arrangement to both send and receive in three essentially uncorrelated modes of operation.

The invention is not limited to the embodiments described above, which only should be regarded as examples of the present invention, but may vary freely within the scope of the appended claims.

Figure 9A:
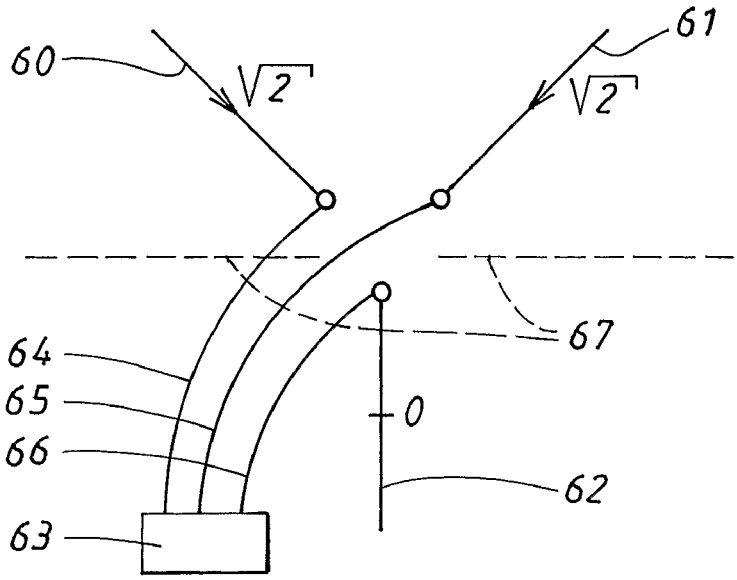
FIG. 9*a* shows how three dipole arms are used to emulate a first electrical dipole.
Figure 9B:
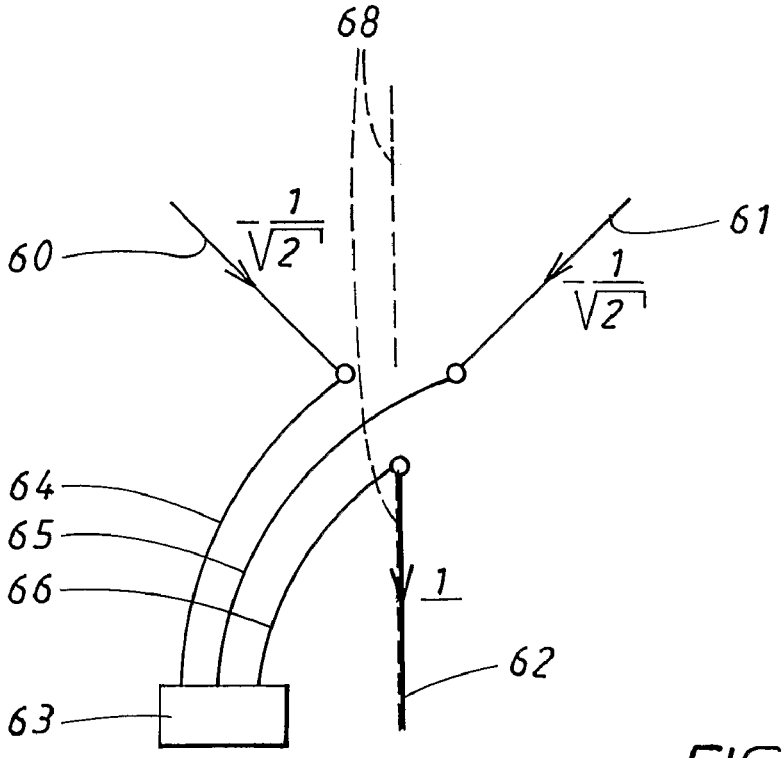
FIG. 9*b* shows how three dipole arms are used to emulate a second electrical dipole.

For example, there does not have to be two discrete dipole antennas. In order to achieve the dipole radiation patterns described, two electrical dipoles have to be achieved, which does not necessarily mean that two discrete dipole antennas are required. Two electrical dipoles may be achieved by using only three dipole arms, a first 60, second 61 and third 62 dipole arm, each arm running outwards from a center point as shown in FIGS. 9*a* and 9*b*. The central ends of the dipole arms are connected to a feeding arrangement 63 by means of appropriate feeding wires 64, 65, 66. The three dipole arms 60, 61, 62 extend in such a way that an angle of essentially 60° is formed between them, i.e. they are extending symmetrically. In the following, the positive direction of the current is from the center and outwards.

In a first mode of operation, as shown in FIG. 9*a*, the first dipole arm 60 is fed with a current having the relative amplitude $-\sqrt{2}$, the second dipole arm 61 is fed with a current having the relative amplitude $\sqrt{2}$ and the third dipole arm 62 is fed with a current having the relative amplitude 0. The resulting first electrical dipole 67 (marked with dashed lines) is directed essentially perpendicular to the third dipole arm 62.

In a second mode of operation, as shown in FIG. 9*b*, the first dipole arm 60 is fed with a current having the relative amplitude $-1/\sqrt{2}$, the second dipole arm 61 is fed with a current having the relative amplitude $-1/\sqrt{2}$ and the third dipole arm 62 is fed with a current having the relative amplitude 1. The resulting second electrical dipole 68 (marked with dashed lines) is directed essentially parallel to the third dipole arm 62.

Two orthogonal electrical dipoles 67, 68 are thus obtained, using only three dipole arms 60, 61, 62.

It is also conceivable to use circularly arranged electrical dipoles, instead of the clover antenna configuration described above, in order to achieve an approximation of a constant current electrical loop.

Figure 10A:
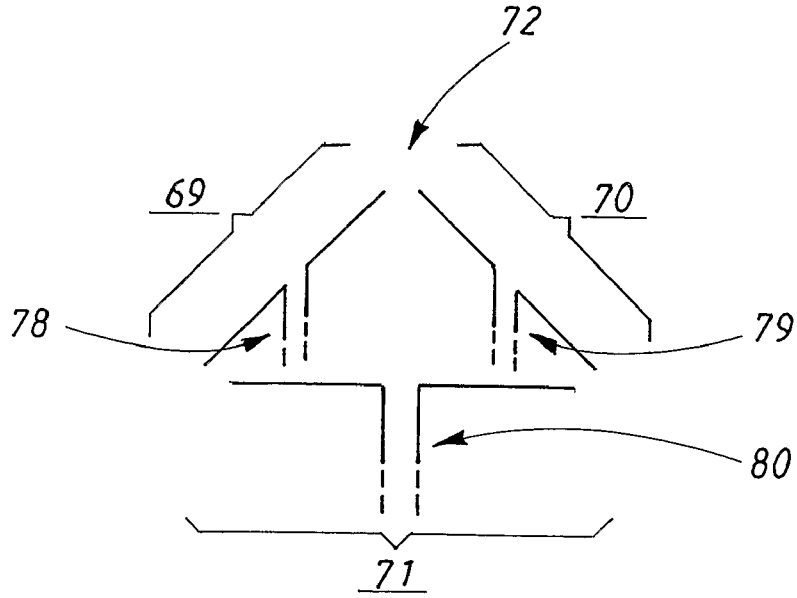
FIG. 10*a* shows a dipole arrangement according to a first case of a first variety.
Figure 10B:
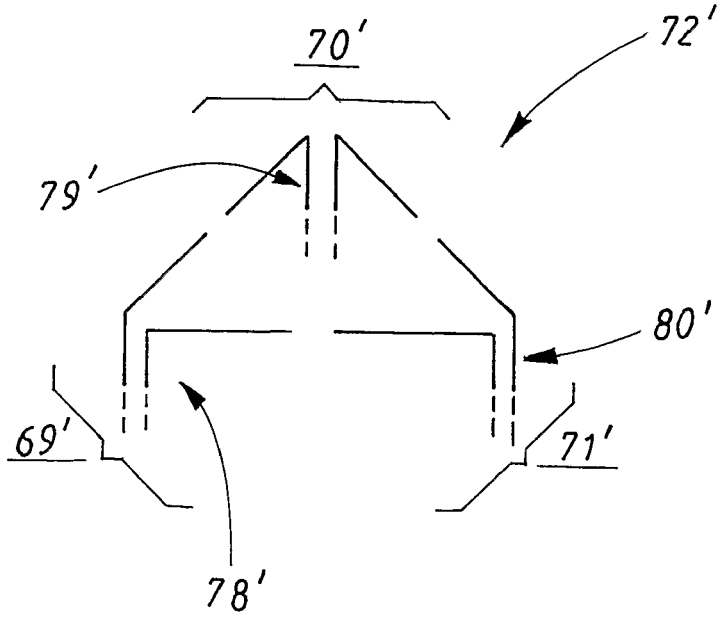
FIG. 10*b* shows a dipole arrangement according to a second case of a first variety.

In a first version, with reference to FIGS. 10*a* and 10*b*, a first 69, 69', second 70, 70' and third 71, 71' electrical dipole, each preferably in the form of a dipole antenna, are arranged in the form of an equilateral triangle 72, 72'. Inside this triangle 72, 72', two more orthogonal electrical dipoles (not shown) are arranged in any one of the ways previously described.

Figure 11A:
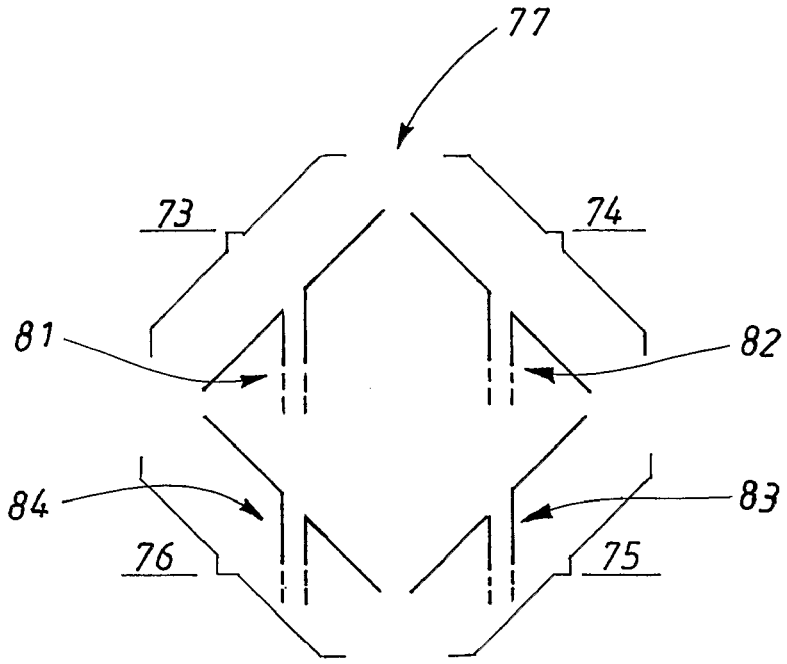
FIG. 11*a* shows a dipole arrangement according to a first case of a second variety.
Figure 11B:
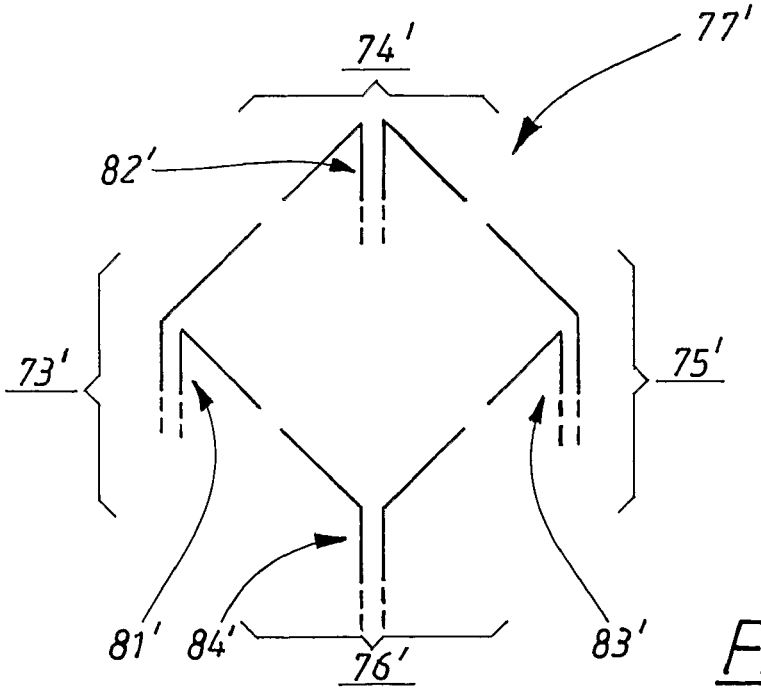
FIG. 11*b* shows a dipole arrangement according to a second case of a second variety.

In a second version, with reference to FIGS. 11*a* and 11*b*, a first 73, 73', second 74, 74', third 75, 75' and fourth 76, 76' electrical dipole, each preferably in the form of a dipole antenna, are arranged in the form of a square 77, 77'. Inside this square 77 77', two more orthogonal electrical dipoles (not shown) are arranged in any one of the ways previously described.

In a first case with reference to FIGS. 10*a*, and 11*a*, corresponding dipole feeding conductor parts 78, 79, 80; 81, 82, 83, 84 are positioned in the middle of each side of the triangle 72 or the square 77, respectively. This results in that each individual electrical dipole 69, 70, 71; 73, 74, 75, 76 is essentially straight.

In a second case with reference to FIGS. 10*b* and 11*b*, corresponding dipole feeding conductor parts 78', 79', 80'; 81', 82', 83', 84' are positioned in each corner of the triangle 72' or the square 77', respectively. This results in that each individual electrical dipole 69', 70', 71'; 73', 74', 75', 76' is angled, 60° for the triangle and 90° for the square.

The dipoles according to the above should be fed in such a way that the currents (not indicated in the Figures) in the dipoles all are essentially in phase with each other, enabling the approximation of a constant current electrical loop, With reference to the examples with reference to FIGS. 10*a*, 10*b*, 11*a* and 11*b*, other geometrical forms are of course conceivable. As for the clover antenna described above, it is possible to use different numbers of circularly arranged electrical dipoles. The more electrical dipoles that are used, the more accurate the approximation of the ideal conducting ring becomes. On the other hand, the more electrical dipoles that are used, the more complicated the antenna structure becomes All planes P, P', P", P"' described are imaginary and added for explanatory reasons only.

The layer configuration described with reference to FIG. 7 is only an example of how such an arrangement may be realized. Many other such configurations are possible within the scope of the invention.

Many other configurations which are not made in planar techniques are also conceivable. As mentioned previously, bent wires may for example be used.

All feeding lines, combining network and connections which are not discussed more in detail in the description are of a commonly known type, easily designed and/or acquired by the skilled person.

The clover antenna is not necessary for carrying out the invention, the essence of that part of the antenna arrangement according to the invention is to provide at least an approximation to a constant current electrical loop lying in the previously mentioned four-leaf clover antenna plane P, which more generally constitutes an antenna plane P in which the resulting approximated constant current electrical loop lies.

A clover antenna according to the embodiments above is a preferred way to provide such an approximation. The number of clover loops may vary, as mentioned above, but should not be less than two in order to provide any positive effect. The loops do not have to lie exactly in the same plane, but may be slightly tilted with the working principle maintained. The direction of the electrical current may vary from the ones disclosed.

The invention claimed is:

1. Antenna arrangement comprising means for providing an approximation of a constant current electrical loop, which approximation of a constant current electrical loop is arranged to provide a first essentially toroid-shaped radiation pattern, where the antenna arrangement further comprises a first and a second electrical dipole, which electrical dipoles are arranged essentially orthogonal to each other, and are arranged to provide a second and third essentially toroid-shaped radiation pattern which each is essentially orthogonal to the other and to the first essentially toroid-shaped radiation pattern, characterized in that the means for approximation of the constant current electrical loop comprises at least two current path parts, where a current can be applied to each one of said parts, so that the current in each one of said parts essentially will be in phase with each other.

2. The antenna arrangement according to claim 1, characterized in that the constant current electrical loop is approximated by a clover antenna.

3. The antenna arrangement according to claim 2, characterized in that the clover antenna is a four-leaf clover antenna.

4. The antenna arrangement according to claim 1, characterized in that the constant current electrical loop is approximated by at least three circularly arranged electrical dipoles.

5. The antenna arrangement according to claim 1, characterized in that each one of the first and second electrical dipoles is formed by means of a dipole antenna, each dipole antenna having two dipole arms.

6. The antenna arrangement according to claim 1, characterized in that each one of the first and second electrical dipoles are formed by means of a dipole antenna arrangement comprising three dipole arms, extending from a central point in such a way that an angle of essentially 60° is formed between them, which dipole antenna arrangement is fed in such a way that the electrical dipoles are formed.

7. The antenna arrangement according to claim 1, characterized in that the antenna arrangement is made using planar techniques.

* * * * *

UNITED STATES PATENT AND TRADEMARK OFFICE

CERTIFICATE OF CORRECTION

PATENT NO. : 7,551,144 B2
APPLICATION NO. : 11/913014
DATED : June 23, 2009
INVENTOR(S) : Manholm et al.

It is certified that error appears in the above-identified patent and that said Letters Patent is hereby corrected as shown below:

In Column 8, Line 26, delete "77 77'," and insert -- 77, 77', --, therefor.

In Column 8, Line 44, delete "loop," and insert -- loop. --, therefor.

In Column 8, Line 52, delete "becomes" and insert -- becomes. --, therefor.

Signed and Sealed this

Seventeenth Day of November, 2009

David J. Kappos

David J. Kappos
*Director of the United States Patent and Trademark Office*